US009579889B2

(12) United States Patent
Lawlor et al.

(10) Patent No.: US 9,579,889 B2
(45) Date of Patent: Feb. 28, 2017

(54) METHOD OF EJECTING INK DROPLETS HAVING VARIABLE DROPLET VOLUMES

(71) Applicant: MEMJET TECHNOLOGY LIMITED, Dublin (IE)

(72) Inventors: Vincent Patrick Lawlor, Dublin (IE); Gregory John McAvoy, Dublin (IE); Ronan Padraig Sean O'Reilly, Dublin (IE); Emma Rose Kerr, Dublin (IE); Misty Bagnat, Dublin (IE)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 14/865,299

(22) Filed: Sep. 25, 2015

(65) Prior Publication Data

US 2016/0129688 A1 May 12, 2016

Related U.S. Application Data

(60) Provisional application No. 62/076,955, filed on Nov. 7, 2014.

(51) Int. Cl.
*B41J 29/38* (2006.01)
*B41J 2/045* (2006.01)

(52) U.S. Cl.
CPC ..... *B41J 2/04585* (2013.01); *B41J 2/04573* (2013.01); *B41J 2/04591* (2013.01); *B41J 2/04593* (2013.01)

(58) Field of Classification Search
None
See application file for complete search history.

(56) References Cited

U.S. PATENT DOCUMENTS 4,509,059 A * 4/1985 Howkins ..... B41J 2/04506 347/10
4,550,326 A * 10/1985 Allen ..... B41J 2/055 347/44
6,331,040 B1 * 12/2001 Yonekubo ..... G06K 15/102 347/15
8,104,874 B2 * 1/2012 Silverbrook ..... B41J 2/14427 347/54

* cited by examiner

*Primary Examiner* — Matthew Luu
*Assistant Examiner* — Tracey McMillion
(74) *Attorney, Agent, or Firm* — Cooley LLP

(57) ABSTRACT

A method of ejecting an ink droplet from an inkjet nozzle device having an actuator and a meniscus pinned across a nozzle opening. The method includes the steps of: delivering a sub-ejection pulse to the actuator for perturbing the meniscus from a quiescent state; and subsequently delivering an ejection pulse to the actuator at an instant when the meniscus is perturbed from its quiescent state, the ejection pulse ejecting the ink droplet from the nozzle opening. A time period between a trailing edge of the sub-ejection pulse and a leading edge of the ejection pulse controls a droplet volume of the ejected ink droplet.

23 Claims, 7 Drawing Sheets

METHOD OF EJECTING INK DROPLETS HAVING VARIABLE DROPLET VOLUMES

This application is a non-provisional application of U.S. Ser. No. 62/076,855 filed Nov. 7, 2014.

FIELD OF THE INVENTION

This invention relates to inkjet nozzle assemblies and methods of ejecting ink therefrom. It has been developed primarily to enable variable droplet volumes on demand.

BACKGROUND OF THE INVENTION

The present inventors have described previously a plethora of MEMS inkjet nozzle devices using thermal bend actuation. Thermal bend actuation generally means bend movement generated by thermal expansion of one material, having a current passing therethough, relative to another material. The resulting bending motion may be used to eject ink from a nozzle opening, optionally via movement of a paddle or vane, which creates a pressure wave inside a nozzle chamber. One such example of a thermal bend actuated inkjet nozzle device is described in U.S. Pat. No. 7,819,503, the contents of which is incorporated herein by reference.

In some circumstances, it is desirable to vary a size of ink droplets ejected from a printhead. For example, printing plain text typically requires maximum black optical density (OD) and it may be desirable to eject relatively large droplet volumes in order maximize black OD for such applications. On the other hand, photo printing typically requires high resolution printing, and it may be desirable to eject relatively small droplet volumes for such applications. Different print media types, ink types and ambient conditions may also impact on the optimum droplet volume for optimum print quality.

U.S. Pat. No. 7,997,690 describes a means of printing with variable droplet volumes by varying a hydrostatic pressure of ink supplied to the printhead. A relatively high hydrostatic pressure produces a convex meniscus in each nozzle and relatively large droplet volumes, whilst a relatively low hydrostatic pressure produces a concave meniscus in each nozzle and relatively small droplet volumes. However, varying the hydrostatic ink pressure may be problematic for several reasons: it complicates the ink delivery system and pressure regulating mechanisms; relatively high hydrostatic ink pressure may cause printhead face flooding and associated printhead maintenance problems; and all nozzles in each color plane must eject droplets of the same volume—for mixed photo and text printing, it may be desirable to eject different droplet sizes in different regions of a page.

It would be desirable to address at least some of the shortcomings described above in connection with U.S. Pat. No. 7,997,690. In particular, it would be desirable to provide an inkjet printhead comprises thermal bend actuated nozzle devices, which does not rely on variable ink pressure for varying droplet volumes.

SUMMARY OF THE INVENTION

In a first aspect, there is provided a method of ejecting an ink droplet from an inkjet nozzle device having an actuator and a meniscus pinned across a nozzle opening, the method comprising the steps of delivering a sub-ejection pulse to the actuator for perturbing the meniscus from a quiescent state; and subsequently delivering an ejection pulse to the actuator at an instant when the meniscus is perturbed from its quiescent state, the ejection pulse ejecting the ink droplet from the nozzle opening, wherein a time period between a trailing edge of the sub-ejection pulse and a leading edge of the ejection pulse controls a droplet volume of the ejected ink droplet.

Preferably, the sub-ejection pulse and the ejection pulse together define a pulse package, each pulse package having a predetermined time period and an associated droplet volume.

Preferably, each pulse package consists of a single sub-ejection pulse and a single ejection pulse.

Preferably, the meniscus is a concave meniscus in its quiescent state.

Preferably, the sub-ejection pulse inverts the concave meniscus into a convex meniscus, the convex meniscus providing relatively higher droplet volumes.

Preferably, the sub-ejection pulse increases the curvature of the concave meniscus, the increased curvature providing relatively lower droplet volumes.

Preferably, a relatively shorter time period produces a relatively larger droplet volume, and a relatively longer time period produces a relatively smaller droplet volume.

Preferably, relatively larger and relatively smaller droplet volumes are generated by a same amount of energy delivered to the actuator.

Preferably, a time period in the range of 0.1 to 2 microseconds produces a larger droplet volume relative to a corresponding ejection pulse without a preceding sub-ejection pulse.

Preferably, a time period in the range of 2.5 to 8 microseconds produces a smaller droplet volume relative to a corresponding ejection pulse without a preceding sub-ejection pulse.

Preferably, the time period is varied to eject ink droplets having different droplet volumes.

Preferably, the time period is varied for different print jobs.

Preferably, an optimum droplet volume is determined for a print job using one or more input parameters.

Preferably, the input parameters comprise one or more of: ink type, media type, user-specified print quality requirements, print speed, ambient temperature, ambient humidity, and a position of the nozzle device in the printhead.

Preferably, the droplet volume is further dependent on one or more of: a pulsewidth of the sub-ejection pulse, an amplitude of the sub-ejection pulse, a pulsewidth of the ejection pulse, an amplitude of the ejection pulse, ink viscosity, ink surface tension, and a backpressure of ink in the printhead.

Preferably, the inkjet nozzle device comprises a nozzle chamber having the nozzle opening defined in a roof thereof and a moving roof portion for ejection of ink from the nozzle opening, whereby actuation of said device moves said moving roof portion towards a floor of the nozzle chamber.

Preferably, the moving roof portion has one or more of the following characteristics at the instant of delivering the ejection pulse: a non-zero displacement; zero or near-zero velocity; and zero or near-zero acceleration. (As used herein, "near-zero velocity" is taken to mean less than 20% or, preferably, less than 10% of maximum velocity. Similarly, "near-zero acceleration" is taken to mean less than 20% or, preferably, less than 10% of maximum acceleration).

Preferably, the moving roof portion comprises the thermal bend actuator.

Preferably, the thermal bend actuator comprises:

an upper thermoelastic beam connected to a pair of electrical contacts; and a lower passive beam mechanically cooperating with said thermoelastic beam, such that when a current is passed through the thermoelastic beam, the thermoelastic beam heats and expands relative to the passive beam resulting in bending of the thermal bend actuator.

In a second aspect, there is provided a printer for ejecting ink droplets according to the method described above. The printer comprises:

a printhead comprising a plurality of inkjet nozzle devices, each inkjet nozzle device having a meniscus pinned across a nozzle opening; and a controller for delivering pulse packages to each inkjet nozzle device, wherein each pulse package comprises:

a sub-ejection pulse for perturbing the meniscus from a quiescent state; and a subsequent ejection pulse for ejecting an ink droplet from the nozzle opening, and wherein a time period between a trailing edge of the sub-ejection pulse and a leading edge of the ejection pulse controls a droplet volume of the ejected ink droplet.

It will be appreciated that preferred features described in connection with the first aspect are, of course, equally applicable to the second aspect.

As used herein, the term "ink" refers to any ejectable fluid and may include, for example, conventional CMYK inks, infrared inks, UV-curable inks, fixatives, 3D printing materials, polymers, biological fluids etc.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
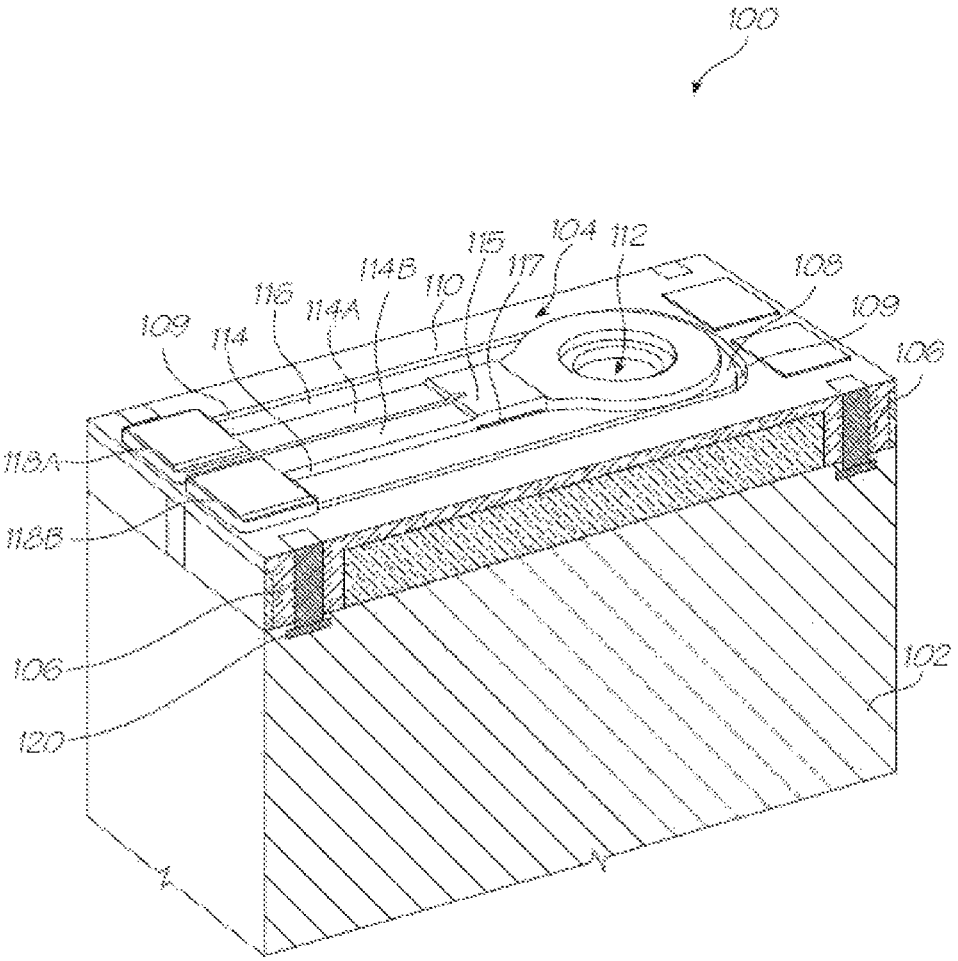
FIG. 1 is a cutaway perspective view a thermal bend acuated inkjet nozzle device at an intermediate stage of fabrication.
Figure 2:
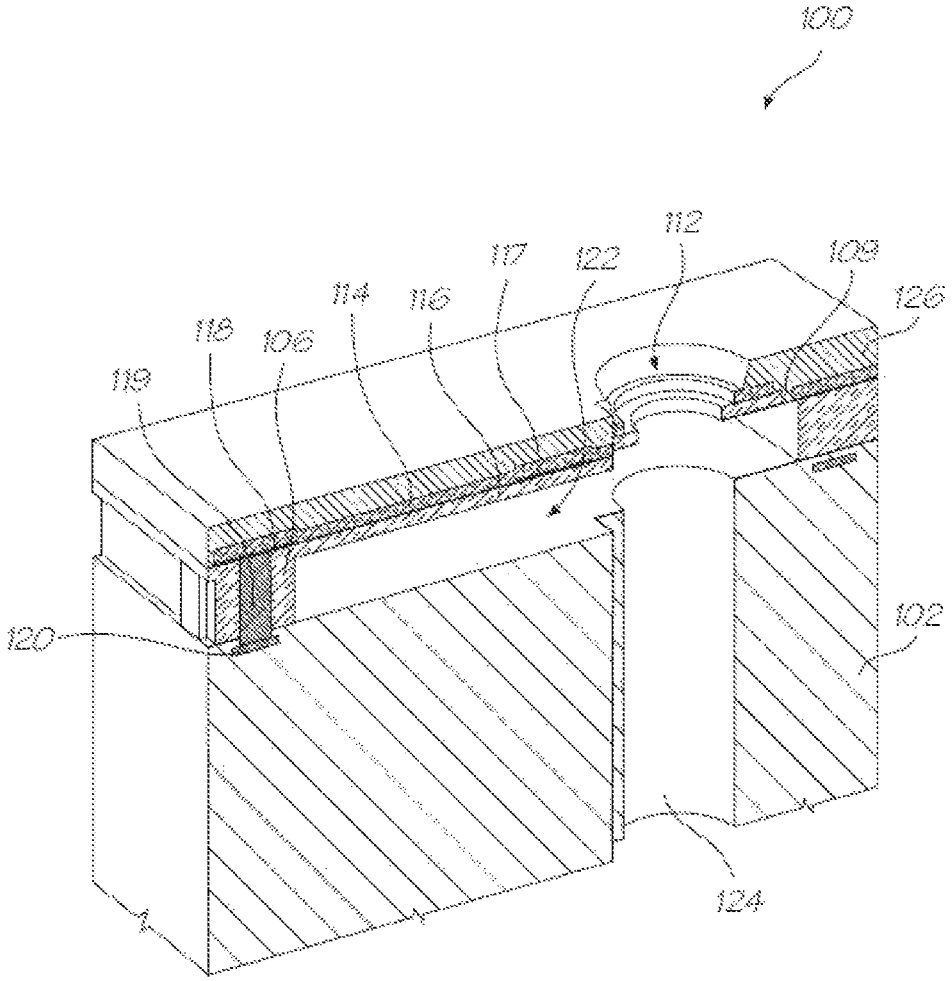
FIG. 2 is a cutaway perspective view the inkjet nozzle device shown in FIG. 1 with a coating layer.

FIGS. 1 and 2 show an illustrative type of thermal bend actuated inkjet nozzle device 100. FIG. 1 shows the device at an intermediate stage of fabrication, before deposition of a coating layer, in order to reveal features of the thermal bend actuator. The inkjet nozzle device 100 is similar in construction to the inkjet nozzle device described in U.S. Pat. No. 7,819,503, the contents of which are incorporated herein by reference.

Referring to FIG. 1, there is shown the inkjet nozzle device 100 formed on a CMOS silicon substrate 102. A nozzle chamber is defined by a roof 104 spaced apart from the substrate 102 and sidewalls 106 extending from the roof to the substrate 102. The roof 104 is comprised of a moving portion 108 and a stationary portion 110 with a gap 109 defined therebetween. A nozzle opening 112 is defined in the moving portion 108 for ejection of ink.

The moving portion 108 comprises a thermal bend actuator having a pair of cantilever beams in the form of an upper thermoelastic beam 114 fused or bonded to a lower passive beam 116. The lower passive beam 116 defines the extent of the moving portion 108 of the roof. The upper thermoelastic beam 114 comprises a pair of arms 114A and 114B which extend longitudinally from respective electrode contacts 118A and 118B. The arms 114A and 114B are connected at their distal ends by a connecting member 115. The connecting member 115 may comprise a conductive pad 117 (e.g. copper, titanium etc), which facilitates electrical conduction around this join region. Hence, the active beam 114 defines a bent or tortuous conduction path between the electrode contacts 118A and 118B.

The electrode contacts 118A and 118B are positioned adjacent each other at one end of the inkjet nozzle device 100 and are connected via respective connector posts 119 to a metal CMOS layer 120 of the substrate 102. The CMOS layer 120 contains the requisite drive circuitry for actuation of the bend actuator.

The passive beam 116 is typically comprised of any electrically and thermally-insulating material, such as silicon oxide, silicon nitride etc. In some embodiments, the passive beam 116 may be bi-layered, having a relatively thin thermally-insulating silicon oxide layer sandwiched between the thermoelastic beam 114 and a relatively thick silicon nitride layer. Inkjet nozzle devices having a bi-layered passive beam and corresponding advantages thereof are described in U.S. Pat. No. 8,079,668, the contents of which are incorporated herein by reference. The thermoelastic beam 114 may be comprised of any suitable thermoelastic material, such as an aluminium alloy (e.g. titanium-aluminium, vanadium-aluminium etc.). As explained in the U.S. Pat. No. 7,984,973, aluminium alloys are a preferred material, because they combine the advantageous properties of high thermal expansion, low density and high Young's modulus.

Referring to FIG. 2, there is shown a completed nozzle assembly 100 at a subsequent stage of fabrication. The nozzle assembly of FIG. 2 has a nozzle chamber 122 and an ink inlet 124 for supply of ink to the nozzle chamber. The ink inlet 124 is aligned with the nozzle opening 112 in the device shown in FIG. 2, but is more usually offset from the nozzle opening 112.

Figure 4:
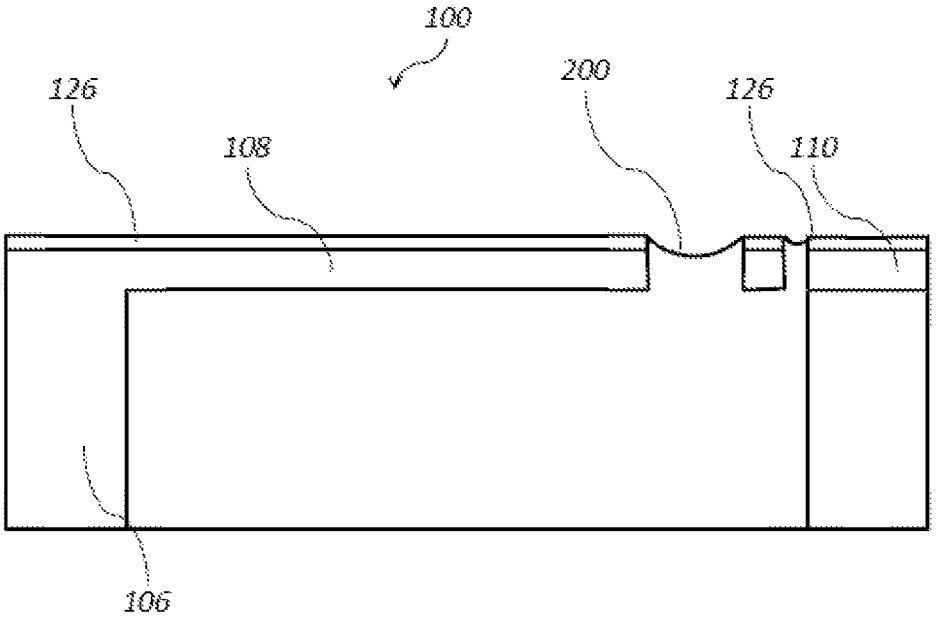
FIG. 4 shows schematically the inkjet nozzle device in a quiescent state.

The roof 104, which defines part of a rigid nozzle plate for the printhead, is covered with a coating layer 126. As shown in FIG. 2, the coating layer fills the gap 109 so as to bridge between the moving portion 108 and stationary portion 110. However, in other embodiments the coating layer 126 may be etched such that it does not bridge between the moving portion 108 and stationary portion 110, providing free movement of the moving portion (see FIGS. 4, 7 and 10). The coating layer 126 may comprise, for example, a polymer coating, such as polydimethylsilicone (PDMS), a polysilsesquioxane (PSQ), an epoxy-based photoresist (e.g. SU-8) etc. Alternatively, the coating layer 126 may comprise a low-k dielectric material.

When it is required to eject a droplet of ink from the nozzle chamber 122, a current flows through the thermoelastic beam 114 between the electrode contacts 118. The thermoelastic beam 114 is rapidly heated by the current and expands. Since the thermoelastic beam 114 is bonded to the passive beam 116, the expansion is constrained and causes the thermoelastic beam 114, and hence the moving portion 108, to bend downwards towards the substrate 102 relative to the stationary portion 110. This movement, in turn, causes ejection of ink from the nozzle opening 112 by a rapid increase of pressure inside the nozzle chamber 122. When current stops flowing, the moving portion 108 is allowed to return to its quiescent position, shown in FIGS. 1 and 2, which sucks ink from the inlet 124 into the nozzle chamber 122, in readiness for the next ejection.

In the nozzle design shown in FIGS. 1 and 2, it is advantageous for the moving portion 108 to comprise the thermal bend actuator. This not only simplifies the overall design and fabrication of the inkjet nozzle device 100, but also provides excellent ejection efficiency because only one face (that is, a lower "working face") of the moving portion 108 has to do work against the relatively viscous ink. By comparison, nozzle assemblies having an actuator paddle positioned inside the nozzle chamber 122 are less efficient, because both upper and lower faces of the actuator have to do work against the ink inside the chamber.

The inkjet nozzle device 100, as described above, typically ejects ink droplets having droplet volumes in the range of 0.8-1.2 pL using a single ejection pulse, depending on fixed parameters, such as nozzle diameter, chamber height, ink surface tension, ink viscosity, ink backpressure etc.

Figure 3:
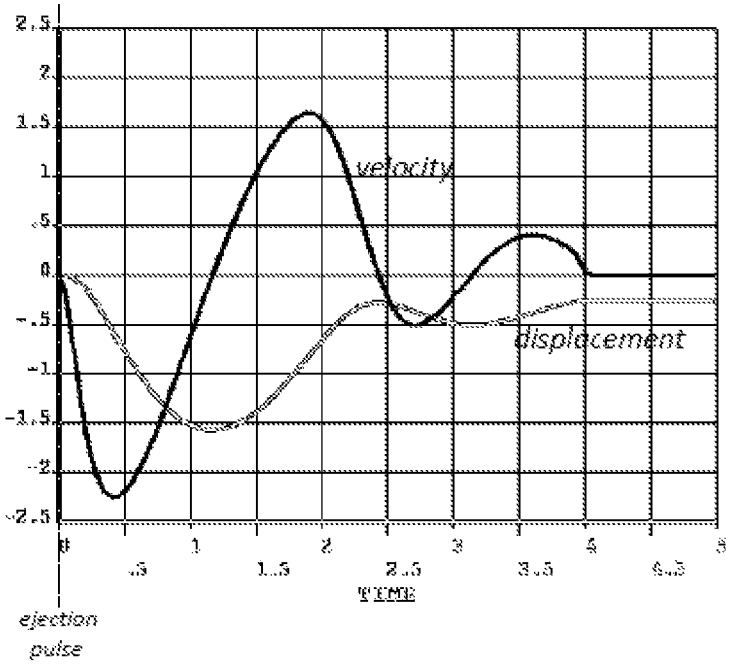
FIG. 3 shows velocity and displacement curves corresponding to a reference ejection pulse.

FIG. 3 shows actuator displacement and velocity curves for the inkjet nozzle device 100 actuated with a single ejection pulse of 0.3 microseconds at time zero. The ejected ink droplet has a droplet volume of 1.01 pL.

At time zero, the actuator is in a quiescent state having zero displacement and velocity at the moment of receiving the ejection pulse. This quiescent state is shown schematically in the inkjet nozzle device 100 of FIG. 4. (Note that the coating layer 126 does not bridge between the moving portion 108 and stationary portion 110 in the embodiment shown in FIG. 4) Ink is pinned across the nozzle opening with a concave meniscus 200 by virtue of ink backpressure. A curvature of this concave meniscus 200 is determined primarily by an amount of backpressure in the ink supply system, which is typically fixed within a predetermined range by a pressure regulator (not shown) upstream of the printhead. The curvature of the concave meniscus 200 is exaggerated in FIG. 4 for clarity.

Figure 5:
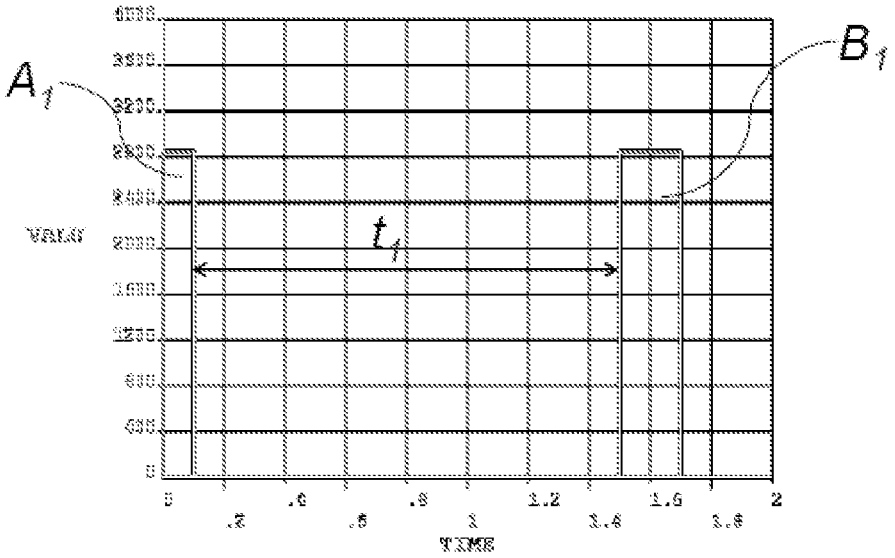
FIG. 5 shows a first pulse package suitable for ejecting relatively larger ink droplets.
Figure 6:
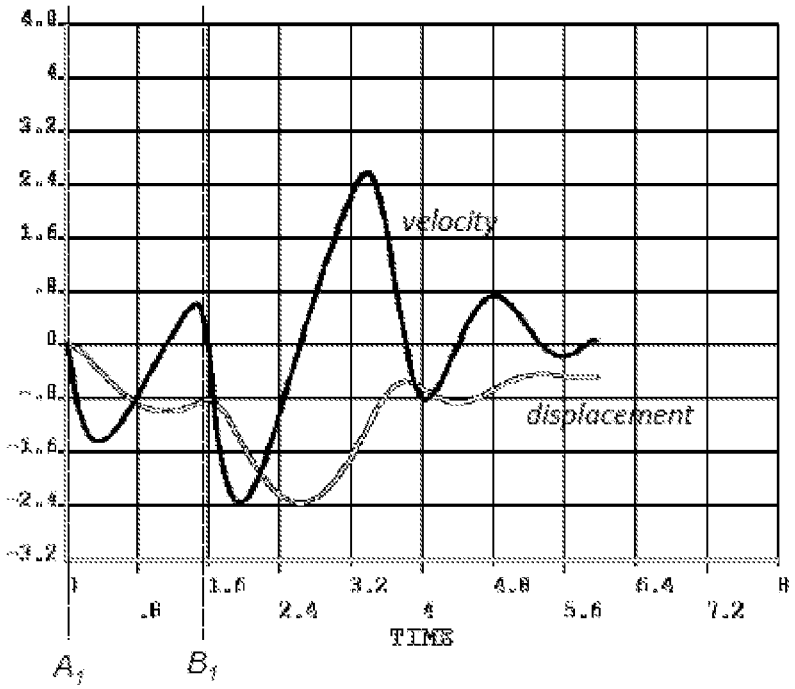
FIG. 6 shows velocity and displacement curves corresponding to the first pulse package shown in FIG. 5.
Figure 7:
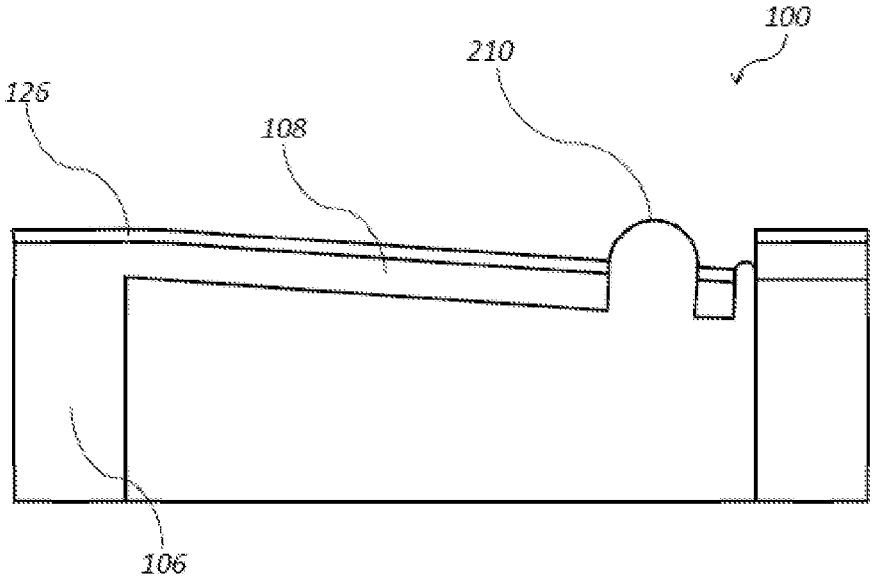
FIG. 7 shows schematically the inkjet nozzle device at an instant of delivering a first ejection pulse $B_1$.

FIGS. 5 to 7 illustrate how relatively larger droplet volumes can be ejected from the inkjet nozzle device 100. Referring initially to FIG. 5, there is shown a first pulse package for ejecting larger droplets than ink droplets ejected from the quiescent state shown in FIGS. 3 and 4. The first pulse package consists of a first sub-ejection pulse $A_1$ having a pulsewidth of 0.1 microseconds, which is followed 1.4 microseconds later by a subsequent first ejection pulse $B_1$ having a pulsewidth of 0.2 microseconds. In other words, a time period $t_1$ between a trailing edge of the first sub-ejection pulse $A_1$ and a leading edge of the first ejection pulse $B_1$ is 1.4 microseconds.

FIG. 6 shows velocity and displacement curves for the moving roof portion 108 of the inkjet nozzle device 100. From FIG. 6, it can be seen that the first ejection pulse $B_1$ is delivered to the device at an instant when the moving roof portion 116 is displaced towards the floor of the nozzle chamber and has zero acceleration. FIG. 7 shows schematically the inkjet nozzle device 100 at the instant of delivering the first ejection pulse $B_1$. It can be seen that the concave meniscus 200 in the quiescent state (FIG. 4) has inverted to a convex meniscus 210 by virtue of the initial movement of the roof portion 108 generated by the first sub-ejection pulse $A_1$. The resultant ink droplet ejected from the concave meniscus 210 has a droplet volume of 1.4 pL, which is 40% larger than the ink droplet ejected from the quiescent state shown in FIGS. 3 and 4.

Figure 8:
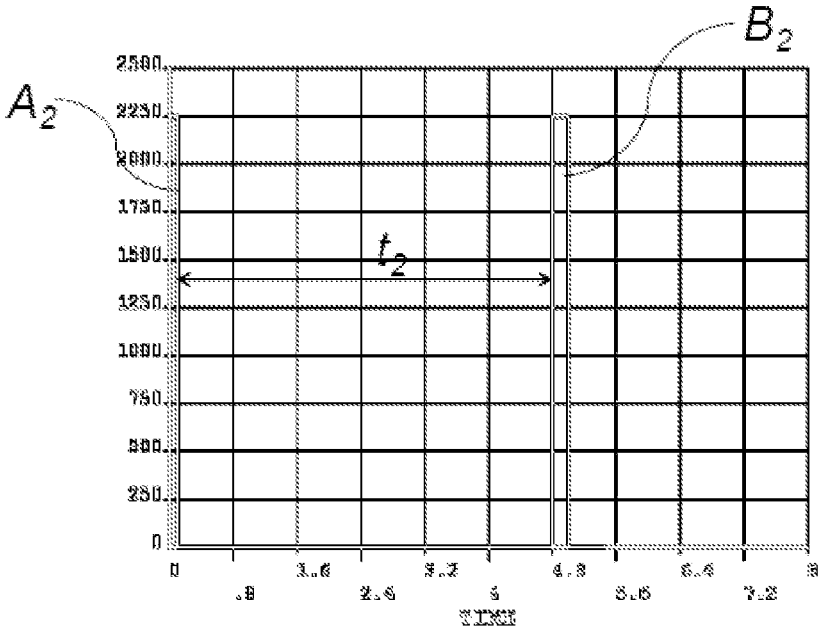
FIG. 8 shows a second pulse package suitable for ejecting relatively smaller ink droplets.
Figure 9:
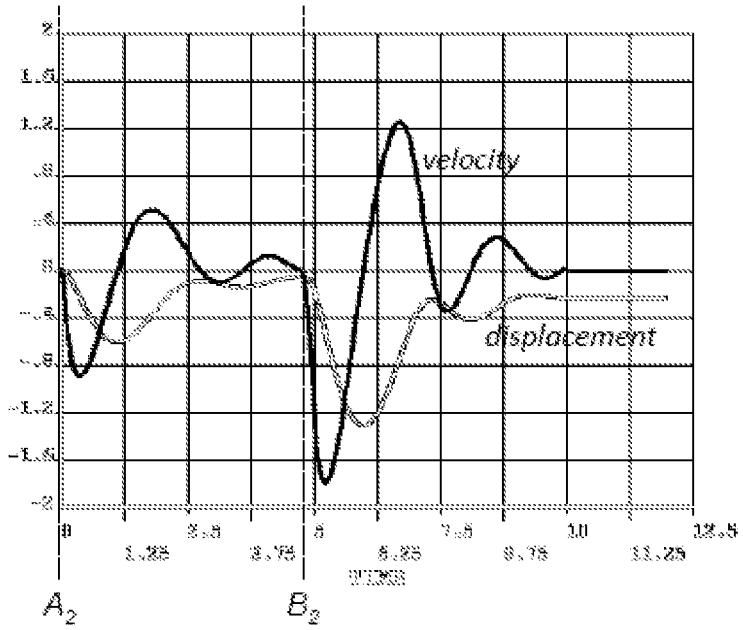
FIG. 9 shows velocity and displacement curves corresponding to the first pulse package shown in FIG. 8.
Figure 10:
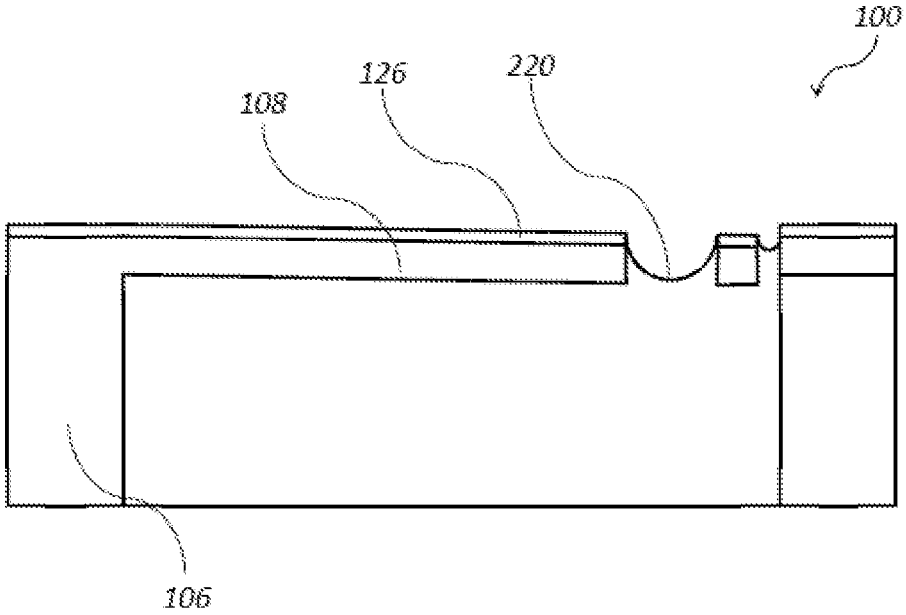
FIG. 10 shows schematically the inkjet nozzle device at an instant of delivering a second ejection pulse $B_2$.

FIGS. 8 to 10 illustrate how relatively smaller droplet volumes can be ejected from the inkjet nozzle device 100. Referring initially to FIG. 8, there is shown a second pulse package for ejecting larger droplets than ink droplets ejected from the quiescent state shown in FIGS. 3 and 4. The second pulse package consists of a second sub-ejection pulse $A_2$ having a pulsewidth of 0.1 microseconds, which is followed 4.7 microseconds later by a subsequent second ejection pulse $B_2$ having a pulsewidth of 0.2 microseconds. In other words, a time period $t_2$ between a trailing edge of the second sub-ejection pulse $A_2$ and a leading edge of the second ejection pulse $B_2$ is 4.7 microseconds.

FIG. 9 shows velocity and displacement curves for the moving roof portion 108 of the inkjet nozzle device 100. From FIG. 9, it can be seen that the second ejection pulse $B_2$ is delivered to the actuator at an instant when the moving roof portion 108 has nearly returned to its quiescent position (FIG. 4), having undergone a non-ejecting displacement towards the floor of the nozzle chamber, and has near-zero velocity. FIG. 7 shows schematically the inkjet nozzle device 100 at the instant of delivering the second ejection pulse $B_2$. It can be seen that the reciprocating movement of the moving roof portion 108, by virtue of the second sub-ejection pulse $A_2$, has generated a concave meniscus 220 having increased curvature relative to the concave meniscus 200 in the quiescent state. (During reciprocal movement of the moving roof portion 108, it will be appreciated that the meniscus 200 will have undergone inversion to the convex meniscus 210 and then returned to the concave meniscus 220 having increased curvature). The resultant ink droplet ejected from the concave meniscus 220 having increased curvature has a droplet volume of 0.6 pL, which is 40% smaller than the ink droplet ejected from the quiescent state shown in FIGS. 3 and 4. Accordingly, the droplet volumes ejected from the inkjet nozzle device 100 may be varied within a range of about ±40% relative to a reference droplet volume, merely by changing the pulse package delivered to the device. In particular, by varying a delay between an initial sub-ejection pulse and a subsequent ejection pulse, different droplet volumes may be ejected. This variation in relative droplet volumes is achieved without any modification of ink backpressures, as described in U.S. Pat. No. 7,997,690. The relatively larger droplet volume may be at least 50%, at least 75%, at least 100% or at least 200% larger than the relatively smaller droplet volume.

Moreover, the total amount of energy delivered to the device is about the same for each droplet ejection, irrespective of whether relatively larger or smaller droplets are ejected. Consistent droplet ejection energies are particularly advantageous, because this simplifies the design of a power supply for delivering power the printhead.

The method described herein may be used to vary relative droplet volumes. However, absolute droplet volumes may be controlled by usual parameters known the art, such as ink chamber geometry, nozzle opening diameter, ink viscosity and surface tension, ink backpressure, energy of ejection pulse etc.

Figure 11:
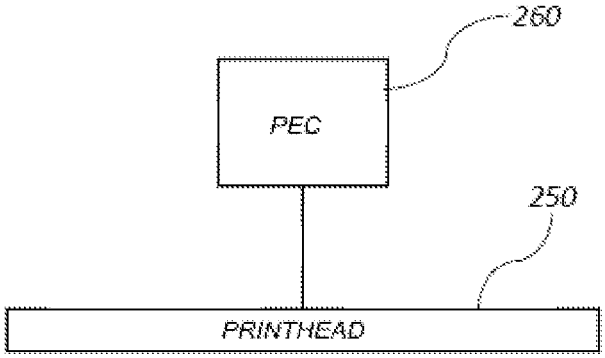
FIG. 11 shows schematically a printer comprising a printhead connected to a controller.

By way of completeness, FIG. 11 shows an inkjet printhead 250, comprising a plurality of inkjet nozzle devices 100, connected to a print engine controller ("PEC") 260. It will be appreciated that the controller 260 may be suitably configured to deliver pulse packages to each inkjet nozzle device 100, which are tailored to a particular print job or tailored to a particular portion of a print job. For example, when printing plain text, the printhead controller 260 may be configured to deliver first pulse packages (FIG. 5) for maximizing optical density. Alternatively, when printing color photos or graphics, the printhead controller may be configured to deliver second pulse packages (FIG. 8) for maximizing print resolution. Alternatively, when printing mixed text and graphics, those nozzles used for printing text may receive first pulse packages, while those nozzles used for printing graphics may receive second pulse packages.

Other parameters may be used to determine an optimum pulse package for a particular print job. For example, media type, ink type, print speed, ambient conditions etc. may be used to determine an optimum pulse package for each inkjet nozzle device 100 in the printhead 250. By way of example, a high viscosity ink, such as a UV-curable ink, will typically require longer time periods between the sub-ejection and ejection pulses than a low viscosity ink.

In practice, optimum pulse packages for a printhead will usually be determined empirically by measuring droplet weights for different time delays. Once time delays for maximum and minimum droplet weights have been determined, then optimum pulse packages for different print jobs may be selected accordingly.

It will, of course, be appreciated that the present invention has been described by way of example only and that modifications of detail may be made within the scope of the invention, which is defined in the accompanying claims.

The invention claimed is:

1. A method of ejecting an ink droplet from an inkjet nozzle device having an actuator and a meniscus pinned across a nozzle opening, said method comprising the steps of:

delivering a sub-ejection pulse to the actuator for perturbing the meniscus from a quiescent state; and subsequently delivering an ejection pulse to the actuator at an instant when the meniscus is perturbed from its quiescent state, the ejection pulse ejecting the ink droplet from the nozzle opening, wherein:

a time period between a trailing edge of the sub-ejection pulse and a leading edge of the ejection pulse controls a droplet volume of the ejected ink droplet;

a relatively shorter time period produces a relatively larger droplet volume; and a relatively longer time period produces a relatively smaller droplet volume.

2. The method of claim 1, wherein the sub-ejection pulse and the ejection pulse together define a pulse package, each pulse package having a predetermined time period and an associated droplet volume.

3. The method of claim 2, wherein each pulse package consists of a single sub-ejection pulse and a single ejection pulse.

4. The method of claim 1, wherein the meniscus is a concave meniscus in its quiescent state.

5. The method of claim 4, wherein the sub-ejection pulse inverts the concave meniscus into a convex meniscus, the convex meniscus providing relatively higher droplet volumes.

6. The method of claim 4, wherein the sub-ejection pulse increases the curvature of the concave meniscus, the increased curvature providing relatively lower droplet volumes.

7. The method of claim 1, wherein relatively larger and relatively smaller droplet volumes are generated by a same amount of energy delivered to the actuator.

8. The method of claim 7, wherein a time period in the range of 0.1 to 2 microseconds produces a larger droplet volume relative to a corresponding ejection pulse without a preceding sub-ejection pulse.

9. The method of claim 7, wherein a time period in the range of 2.5 to 8 microseconds produces a smaller droplet volume relative to a corresponding ejection pulse without a preceding sub-ejection pulse.

10. The method of claim 1, wherein the time period is varied to eject ink droplets having different droplet volumes.

11. The method of claim 1, wherein the time period is varied for different print jobs.

12. The method of claim 11, wherein an optimum droplet volume is determined for a print job using one or more input parameters.

13. The method of claim 12, wherein the input parameters comprise one or more of: ink type, media type, user-specified print quality requirements, print speed, ambient temperature, ambient humidity, and a position of the nozzle device in the printhead.

14. The method of claim 1, wherein the droplet volume is further dependent on one or more of: a pulsewidth of the sub-ejection pulse, an amplitude of the sub-ejection pulse, a pulsewidth of the ejection pulse, an amplitude of the ejection pulse, ink viscosity, ink surface tension, and a backpressure of ink in the printhead.

15. The method of claim 1, wherein the inkjet nozzle device comprises a nozzle chamber having the nozzle opening defined in a roof thereof and a moving roof portion for ejection of ink from the nozzle opening, whereby actuation of said device moves said moving roof portion towards a floor of the nozzle chamber.

16. The method of claim 15, wherein the moving roof portion has one or more of the following characteristics at the instant of delivering the ejection pulse: a non-zero displacement; zero or near-zero velocity; and zero or near-zero acceleration.

17. The method of claim 15, wherein the moving roof portion comprises the actuator.

18. The method of clam 17, wherein the actuator is a thermal bend actuator comprising:

an upper thermoelastic beam connected to a pair of electrical contacts; and a lower passive beam mechanically cooperating with said thermoelastic beam, such that when a current is passed through the thermoelastic beam, the thermoelastic beam heats and expands relative to the passive beam resulting in bending of the thermal bend actuator.

19. A method of ejecting an ink droplet from an inkjet nozzle device having an actuator and a meniscus pinned across a nozzle opening, said method comprising the steps of:

delivering a sub-ejection pulse to the actuator for perturbing the meniscus from a quiescent state; and subsequently delivering an ejection pulse to the actuator at an instant when the meniscus is perturbed from its quiescent state, the ejection pulse ejecting the ink droplet from the nozzle opening, wherein:

a time period between a trailing edge of the sub-ejection pulse and a leading edge of the ejection pulse controls a droplet volume of the ejected ink droplet, and wherein the time period is varied for different print jobs.

20. The method of claim 19, wherein an optimum droplet volume is determined for a print job using one or more input parameters.

21. The method of claim 20, wherein the input parameters comprise one or more of:

ink type, media type, user-specified print quality requirements, print speed, ambient temperature, ambient humidity, and a position of the nozzle device in the printhead.

22. The method of claim 19, wherein the droplet volume is further dependent on one or more of: a pulsewidth of the sub-ejection pulse, an amplitude of the sub-ejection pulse, a pulsewidth of the ejection pulse, an amplitude of the ejection pulse, ink viscosity, ink surface tension, and a backpressure of ink in the printhead.

23. A method of ejecting an ink droplet from an inkjet nozzle device having a moving roof portion controlled by an actuator for ejection of ink from a nozzle opening having a meniscus, said method comprising the steps of:

delivering a sub-ejection pulse to the actuator for perturbing the meniscus from a quiescent state; and subsequently delivering an ejection pulse to the actuator at an instant when the meniscus is perturbed from its quiescent state, the ejection pulse ejecting the ink droplet from the nozzle opening, wherein:

a time period between a trailing edge of the sub-ejection pulse and a leading edge of the ejection pulse controls a droplet volume of the ejected ink droplet; and the moving roof portion has one or more of the following characteristics at the instant of delivering the ejection pulse: a non-zero displacement; zero or near-zero velocity; and zero or near-zero acceleration.

* * * * *